US008610520B2

(12) United States Patent
Froemel et al.

(10) Patent No.: US 8,610,520 B2
(45) Date of Patent: Dec. 17, 2013

(54) ELECTROSTATICALLY ACTUATED MICRO-MECHANICAL SWITCHING DEVICE

(75) Inventors: Joerg Froemel, Chemnitz (DE); Thomas Gessner, Chemnitz (DE); Christian Kaufmann, Burgstaedt (DE); Stefan Leidich, Chemnitz (DE); Markus Nowack, Pockau (DE); Steffen Kurth, Thalheim (DE); Andreas Bertz, Chemnitz (DE); Koichi Ikeda, Atsugi (JP); Akira Akiba, Atsugi (JP)

(73) Assignees: Fraunhofer-Gesellschaft zur Foerderung der Angewandten Forschung E.V., Munich (DE); Sony Corporation, Tokyo (JP)

( * ) Notice: Subject to any disclaimer, the term of this patent is extended or adjusted under 35 U.S.C. 154(b) by 336 days.

(21) Appl. No.: 13/155,002

(22) Filed: Jun. 7, 2011

(65) Prior Publication Data

US 2011/0303515 A1 Dec. 15, 2011

(30) Foreign Application Priority Data

Jun. 9, 2010 (EP) ..... 10401078

(51) Int. Cl.
*H01H 51/22* (2006.01)
*H01P 1/10* (2006.01)

(52) U.S. Cl.
USPC ..... 335/78; 333/101

(58) Field of Classification Search
USPC ..... 335/78; 333/101, 105
See application file for complete search history.

(56) References Cited

U.S. PATENT DOCUMENTS 7,142,087 B2 11/2006 Greywall
7,689,070 B2 * 3/2010 Ouchi ..... 385/8

(Continued)

FOREIGN PATENT DOCUMENTS

DE 10 2006 001 321 B3 7/2007
DE 60 2005 002 277 T2 5/2008

(Continued)

OTHER PUBLICATIONS

European Patent Office Search Report, Dated Nov. 12, 2010.

*Primary Examiner* — Alexander Talpalatski
(74) *Attorney, Agent, or Firm* — Laurence A. Greenberg; Werner H. Stemer; Ralph E. Locher

(57) ABSTRACT

An electrostatically actuated micro-mechanical switching device with movable elements formed in the bulk of a substrate for closing and releasing at least one Ohmic contact by a horizontal movement of the movable elements in a plane of the substrate. The switching device has a drive with comb-shaped electrodes including fixed driving electrodes and movable electrodes. A movable push rod is mechanically connected with the movable electrodes, extends through the electrodes, has a movable contact element at one side, and at least one restoring spring. A signal line has two parts interrupted by a gap. The micro-mechanical switching device is in shunt-configuration with low loss, high isolation in a wide frequency range, low switching time at low actuation voltage and sufficient reliability. The line impedance of the signal line and its variation is as small as possible. The switching device is in shunt-configuration for closing and releasing the Ohmic contact between a ground line and the signal line. The contact element has a movable contact beam extending at least partially opposite to the signal line and being electrically and mechanically connected to both parts of the signal line, respectively. The ground line is formed with a contact bar that leads through the gap of the signal line for forming the Ohmic contact between the contact beam and the ground line. A contact metallization is provided at least on top and on the side walls of the contact beam, of the signal line and of the ground line.

16 Claims, 7 Drawing Sheets

(56) References Cited

U.S. PATENT DOCUMENTS

| | | | | |
|---|---|---|---|---|
| 2003/0102936 | A1 | 6/2003 | Schaefer | |
| 2004/0095205 | A1 * | 5/2004 | Schaffner et al. | 333/101 |
| 2005/0099252 | A1 | 5/2005 | Isobe et al. | |
| 2009/0219113 | A1 | 9/2009 | Kaiser et al. | |

FOREIGN PATENT DOCUMENTS

| | | | |
|---|---|---|---|
| DE | 10 2007 013 102 | A1 | 9/2008 |
| DE | 10 2007 035 633 | A1 | 2/2009 |
| WO | 2008/110389 | A1 | 9/2008 |

* cited by examiner

ELECTROSTATICALLY ACTUATED MICRO-MECHANICAL SWITCHING DEVICE

CROSS-REFERENCE TO RELATED APPLICATION

This application claims the priority, under 35 U.S.C. §119, of European patent application EP 10401078.0, filed Jun. 9, 2010; the prior application is herewith incorporated by reference in its entirety.

BACKGROUND OF THE INVENTION

Field of the Invention

The present invention relates to an electrostatically actuated micro-mechanical switching device with movable elements formed in the bulk of a substrate for closing and releasing at least one Ohmic contact by a horizontal movement of the movable elements in a plane of the substrate; the switching device comprising: a drive with comb-shaped electrodes, wherein the electrodes comprise fixed driving electrodes and movable electrodes; a movable push rod being mechanically connected with the movable electrodes and extending through the electrodes; a movable contact element being mechanically connected with one side of the push rod; at least one restoring spring being mechanically connected with the push rod; a signal line and a ground line, wherein the signal line comprises two parts being interrupted by a gap.

Micro mechanical switches for electric signals, i.e., radio frequency (RF) signals, are known from several publications. The basic concepts can be divided into categories based on the method of generating the force used for mechanical actuation, on fabrication technology and on the type of contact. In general, the contact of the switch can be of an Ohmic nature, realized by metal-metal-contacts or of a capacitive nature. In the case of a capacitive switch, the signal flow is controlled by a capacitance contact either connected in series or in parallel with the transmission line.

As mentioned above, the present invention pertains to electrostatically actuated devices with Ohmic contacts. The fabrication technology of interest is widely described as "bulk technology." In bulk technology, the functional elements of the mechanical domain are structured into the depth of the wafer material whereas so-called surface technologies transfer mechanical elements into previously deposited layers of material.

Following major demands on micro mechanical switches have been derived from potential applications: low actuation voltage in the range below 5 V, negligible actuation power consumption, short switching time of less than 10 μs, perfect isolation in dc-range, isolation better than −30 dB in RF range, less than 0.2Ω on resistance, power loss in on state better than −0.5 dB, negligible cross talk from actuation to the signal ports, high self actuation voltage of more than 10 V, life time of more than 1 billion switching cycles, and extremely small outline in case of integrated switches or small footprint of the packaged switch component.

For a variety of reasons, it is desirable to maximize the actuation force. Most RF applications require fast switching of the signal pathways. All functional elements of a mechanical switch provide inertial mass. The linear relationship between force and acceleration implies that high force will lead to faster reaction. It is also known that the reliability of an Ohmic contact is significantly affected by the contact force. Low contact forces result in high contact resistances and possibly excessive heating due to current flow. Low forces also lead to small contact area. The actual contact may occur only at small surface asperities which can lead to early failure of the device.

One can conclude that the generation of a relatively high actuation force plays a pivoting role in case of Ohmic switches since low switching time, low contact resistance, and high reliability is achieved by sufficient actuation force to accelerate the mechanically movable structures fast enough, to obtain a sufficient contact force and to overcome the adhesion forces of the closed contacts when opening them. Low actuation voltage is contrary to high actuation force and challenging therefore.

The electrostatic actuation relies on forces between differently polarized electrodes. A difference of potential between two conducting entities causes an electric field which stores energy. If a change of position of the conducting entities would influence the amount of energy stored into the field, i.e. the capacitance, an attractive force will act on both entities. This force has an orientation that it would lead, if not mechanically prevented, to a movement into the spatial direction of the energy gradient. The situation can be described by the following equation:

$$F = \frac{1}{2}U^2\frac{\delta C}{\delta x}, \tag{1}$$

wherein F is the mechanical force, U is the actuation potential, x is the mechanical travel, and C is the electrical capacitance.

According to equation (1) the force can be increased by increasing the actuation potential or by increasing the capacitance gradient. The increase of the voltage is commonly subject to limitation determined by the application. A common design goal is to maximize the gradient of capacitance. Assuming a simple parallel plate capacitor and one degree of freedom the gradient of capacitance can be described as follows:

$$\frac{\delta C}{\delta x} = \frac{\varepsilon_0\varepsilon_r A}{(g_0 - x)^2}, \tag{2}$$

wherein $\in_0$ is the permittivity of vacuum, $\in_r$ is the relative permittivity of the dielectric material, A is the surface area of the electrodes, and $g_0$ is the initial separation. Since only gases with $\in_r \approx 1$ or vacuum are suitable dielectric materials, the general design goal is to maximize the surface area and to minimize the electrode separation.

An obvious way to increase the electrode area is to use larger electrodes. At least two facts exclude this method from a practical solution. Increasing the physical dimension of functional elements usually leads to a higher size of the devices on the wafer. The consequences are higher costs and lower fabrication yield. Beside fabrication issues, bigger devices will also raise integration difficulties.

The capacitance of the combs can be calculated by $$C_c = \frac{\varepsilon_0 \cdot l \cdot th \cdot 2 \cdot n}{g_{0c}}, \tag{3}$$

where l is the length of the combs, th is the thickness of the combs into the depth of the wafer, $g_{0c}$ is the separation of the combs, and n is the number of comb pairs. Assuming the same lateral dimension, the capacitance of a parallel plate capacitor can be calculated by $$C_p = \frac{\varepsilon_0 \cdot l \cdot n \cdot (2w + 2g_{0c})}{g_{0p}}, \quad (4)$$

wherein w is the width of combs and $g_{0p}$ is the separation of the electrodes. The comb shape electrode provides more capacitance per unit area than a parallel plate capacitor if the following condition is fulfilled:

$$\frac{C_c}{C_p} = \frac{g_{0p} \cdot th}{g_{0c}(w + g_{0c})} > 1. \quad (5)$$

Rearranging (5) and substituting the ratio of th and $g_{0c}$ by the AR the aspect ratio the following relation can be derived:

$$g_{0p} > \frac{w + g_{0c}}{AR}. \quad (6)$$

Relation (6) states that the advantage of comb shape electrodes directly depends on the maximal possible aspect ratio of the etching process. Assuming technologically feasible figures for the relevant parameters as $g_{0p}$=1 μm, w=1 μm, $g_{0c}$=4 μm, and th=40 μm (AR=10) the comb shaped design provides 8 times higher capacitance per unit area. It can be concluded that comb shaped electrodes are advantageous in terms of obtaining high actuation capacitance.

However, regarding electrostatic actuation, the high capacitance only serves as an intermediate result. According to equation (1) the force is proportional to the gradient of capacitance. A symmetric design, as used for the previous calculations, does not yield any net force in the direction of interest, i.e. orthogonal to the orientation of the comb. The obvious solution to break the symmetry is to use an asymmetric layout, i.e. $g_{0c}$ is different at both sides of the combs. Since $g_{0c}$ is usually selected as small as technologically possible, different $g_{0c}$ commonly means increasing $g_{0c}$ at one side. A more elegant approach to create asymmetric separation is to fabricate symmetric combs with minimal separation and displace the movable structure in a post processing step. This principle is referred to as gap reduction in the following.

It is easily possible but somewhat lengthy to derive analytic descriptions for the ratio of forces obtained by the comb shape design and by the parallel plate capacitor. However, referring to the earlier mentioned numeric example, the actuation forces equal if the movable structure is deflected by 2.1 μm. At 3 μm deflection and therewith 1 μm remaining electrode separation, which is a practically proven safe minimal number, the force of the comb shape design is 4 times higher. It can be concluded that the technique of gap reduction allows transferring the advantage of a high capacitance successfully into high mechanical force.

Beside high force, gap reduction has an additional important advantage. By bringing the movable and solid elements closer together, the remaining travel of the contact elements and therewith the switching time is reduced. Ohmic contact switches do only require small travel for reliable switching. Even considering surface roughness, flexibility, and electric break through the minimal travel is usually one order of magnitude smaller than the minimal $g_{0c}$.

One possible solution to implement gap reduction is shown in patent application publication No. US 2009/0219113 A1. There, there is described a movable structure that is deflected out of its initial position. The motion is stopped by contact elements which are called stoppers in the following. The existence of stoppers might appear contradictorily since the separation to the movable element needs to be smaller than the initially defined minimal separation. However, it is practically possible to locally deviate from the design rules. The term "locally" means that the design at the location of the stoppers is investigated by the designer very carefully. The surrounding elements need to be specially adapted to the requirements of the stoppers. Consequently, it is not possible to fabricate that small separation at any location. The design rules remain.

The practical suitability of a gap reduction mechanism is defined by the periphery that is required for one time actuation and by the technique to permanently maintain the state of reduced gap. The additional periphery should consume only a small amount of wafer area to not counteract the advantage of the general concept. The latching mechanism should not rely on the application of permanent driving signals. Otherwise, this would lead to continuous power consumption or to possibly unknown states after failure of the supplies.

A technique to maintain deflected states of a laterally movable entity is described in U.S. Pat. No. 7,142,087 B2 (cf. German published document DE 60 2005 002 277 T2). The mechanical latching is the result of form-fitting between mechanical structures. A disadvantage of the concept becomes obvious, if a lateral spacing according to the minimal separation is predetermined. In this case mechanical latching at intermediate position, i.e. fractions of $g_{0c}$, is difficult to implement. The large size and complex shape of the form-fitting elements do not qualify for a local deviation of the design rules.

Independent of the actual implementation (parallel plate or comb shaped electrodes) the actuation mechanism needs to be coupled to the contact elements. The term "contact elements" describes metallised structures that are driven into physical contact to implement the switching function. There are good reasons to implement some kind of elasticity between the actuator and the contact elements.

United States patent application publications Nos. US 2003/0009861 A1 and US 2005/0099252 A1 describe the use of a flexible contact to implement a progressive spring. The additional elasticity is inactive in the open-state of the switch. Initially, the actuator only needs to provide a force that deflects the main spring, i.e. the spring that connects the contact with the frame. The actuation voltage can be low. At the moment of contact, the contact elasticity comes into action. The travel of the actuator is not stopped. The separation between the driving electrodes continues to decrease. Consequently, the force increases. Due to mechanical series connection, the force acts on the contact in its full extent.

Most implementations of switches using surface technologies rely on physical contact of the driving electrodes. An isolation layer in between prevents electrical short. However, this layer is commonly subject to electric charging. The charging of the isolation prevents the switch from being released. This mode of failure is usually called sticking. The invention described in patent application publications Nos. US 2003/0009861 A1 and US 2005/0099252 A1 uses the progressive spring not only for an increase of the contact force but preferably for an increase of the release force. It is important to notice, that the additional release force only acts on the actuation electrode. The contact itself is released only by the force of the main spring which is usually low to keep the actuation voltage low.

The commonly assigned international patent application publication WO 2008/110389 A1 describes a switching device of the above mentioned type. The document includes the idea to provide an element for an increase of the mechanical force and an assembly for a high frequency isolation of the switch between the electrostatic drive and the contact beam. The element for the increase of the mechanical force is either a lever mechanism between the electrostatic drive and the contact beam and/or an elastic element with a progressive effect or a clutch mechanism provided in the flux of forces between the electrostatic drive and the contact beam, respectively. The high frequency isolation is realized by an interruption of the metallization on the lever mechanism.

Many applications for electrostatically actuated MEMS switches require low insertion loss and high isolation (e.g. −0.5 dB and −30 dB, respectively) in a wide frequency range (e.g. 1 MHz . . . 100 GHz). Low switching time (e.g. less than 10 μs) should be achieved with low actuation voltage (e.g. 5 V), and the switch has to be designed so that contact wear and contact sticking do not limit the reliability to less than $10^9$ switch cycles. MEMS switches in a shunt configuration in which the contact element of the switch is permanently connected with the signal line and serves for an electric connection with the ground potential of the switch basically comply with the frequency range and the isolation requirements, but following difficulties arise:

Short switching time and sufficient reliability make relatively strong actuation force necessary. This is in contrast to the demands for low actuation voltage. A possible solution is the application of horizontally actuating comb drive electrodes, because of the relatively high electrode area in comparison to vertically actuating electrodes. But the mechanical coupling between the electric shunt contact and the actuator has to be achieved without disjoining the signal line, since the complete frequency band is to be transmitted, and the line impedance should vary as small as possible.

A further possible solution would be a flexible part of the signal line, which may carry the shunt contact and which is mechanically coupled to the actuator, and provides an additional force due to its bending when the switch is actuated. This force counteracts the actuation force and reduces the contact force, resulting in higher necessary actuation voltage. An extremely narrow and long flexible part of the signal line would be a way out, but the impedance of this kind of signal line strongly deviates from feeding lines impedances in most cases.

SUMMARY OF THE INVENTION

It is accordingly an object of the invention to provide a micro-mechanical switching device, which overcomes the above-mentioned disadvantages of the heretofore-known devices and methods of this general type and which provides for such a switching device in shunt-configuration with low loss, high isolation in a wide frequency range, low switching time at low actuation voltage and sufficient reliability. The switching device is configured such that the line impedance of the signal line and its variation is as small as possible.

With the foregoing and other objects in view there is provided, in accordance with the invention, an electrostatically actuated micro-mechanical switching device, comprising:

movable elements formed in a bulk of a substrate for closing and releasing at least one Ohmic contact by a horizontal movement of the movable elements in a plane of the substrate, including:

a drive with comb-shaped electrodes, the electrodes including fixed driving electrodes and movable electrodes;

a movable push rod mechanically connected with the movable electrodes and extending through the comb-shaped electrodes;

at least one restoring spring mechanically connected with the push rod;

a signal line having two parts interrupted by a gap;

a contact element mechanically connected with one side of the push rod, the contact element including a movable contact beam extending at least partially opposite the signal line and being electrically and mechanically connected to each of the two parts of the signal line;

a ground line having at least one contact bar extending through the gap in the signal line for forming the Ohmic contact between the contact beam and the ground line; and a contact metallization formed at least on top and on side walls of the contact beam, of the signal line, and of the ground line; and wherein the switching device is in shunt-configuration for closing and releasing the Ohmic contact between the ground line and the signal line.

In other words, the objects of the invention are achieved by an electrostatically actuated micro-mechanical switching device of the above mentioned type wherein the switching device is in shunt-configuration for closing and releasing the Ohmic contact between the ground line and the signal line, wherein the contact element comprises a movable contact beam extending at least partially opposite to the signal line and being electrically and mechanically connected to both parts of the signal line, respectively; the ground line comprises at least one contact bar leading through the gap of the signal line for forming the Ohmic contact between the contact beam and the ground line; and a contact metallization is provided at least on top and on the side walls of the contact beam, of the signal line and of the ground line.

According to the present invention which provides a switching device in shunt-configuration with a contact beam which is at its both ends mechanically and electrically connected with the signal line, which is typically but not necessarily a coplanar strip signal line, and which is furthermore connected with the movable push rod being actuated by the electrodes. The contact beam is bended by the actuation force. The dimensions of the contact beam are chosen that way that it provides high elasticity, and therefore low force counteracting the actuation. Nevertheless, the contact beam provides additional restoring force. This force can be used to prevent contact sticking. However, too high restoring force causes high minimum actuation voltage which is not desirable. It is therefore necessary in accordance with the present invention to use a rather long and thin contact beam as described below with reference to the drawings. Such a thin beam has high inductance.

At lower frequencies and DC, the inductance of the contact beam is not critical. It is critical at high GHz frequencies, however. Therefore, the present invention suggests a switching device wherein a significant part of the signal line is arranged in parallel to the contact part in order to form an additional capacitive coupling for high frequency. Thus, an additional current path is created which reduces the inductive influences of the long contact beam. It is therefore possible to fulfil the demands for low stiffness without suffering from mismatch of the line impedance.

The isolation of Ohmic switches in high frequency range is limited by capacitive cross-talk from input port to output port. Therefore, in the present invention two contact sets are applied in series within the signal line which are both open in the off-state and closed in the on-state. The contacts are located on both sides of an elastic contact beam.

The resistance of the movable contact beam contributes to the on-resistance of the switch and to power loss in on-state. Therefore, the electric connection between the both contacts at the contact beam or the resistance of the contact beam is in series to the signal line and would limit the performance of the switching device. Therefore, the present invention suggests the deposition of a metal on top and also on the side walls of the contact beam, of the ground line and of the signal line, resulting in a significant decrease of this resistance. That contact metallization can be realized for instance by metal sputtering after structuring of the contact beam. In this case, a shadow mask has to be applied for defining the metallization area. Alternatively, a relatively thick metal layer can be applied before structuring of the movable part of the switching device by electroplating. It may be used as contact material for the movable and the fixed contacts as well. However, that alternative solution includes the necessity of a protection of this layer during silicon etch processes and a possible contamination of the contact surface during subsequent processes.

In order to achieve high actuation force and low switching time, both the separation of the movable and the fixed contact tips in the non activated state and the separation of the movable and the fixed actuation electrodes should be as small as possible. Fabrication technology restrictions limit the minimum size of the spacing between the electrodes and between the contact tips. Thus, according to a favourite embodiment of the present invention, a gap reduction mechanism which is activated at the end of the fabrication sequence is applied to achieve a lower separation. The gap reduction mechanism comprises a movable frame being provided at a fixed end of each restoring spring and surrounding at least partially one fixed sticking pad, wherein the movable frame is opposite to at least one additional attracting electrode and elastically suspended so that the movable frame moves towards the sticking pad when an activation voltage is applied to the additional attracting electrode, wherein the movable frame comes to rest at the sticking pad at the side of the connection between the movable frame and the restoring spring, and wherein the sticking pad and the movable frame are permanently joined in that constellation by micro welding. After performing the gap reduction procedure with every movable frame, the driving electrode separation and the contact separation are permanently reduced. Since the sticking pads are provided that way that they come into contact with the movable frame at the side of the connection between the movable frame and the restoring spring, the influence of fabrication tolerances to the restoring force can be reduced.

In accordance with an added feature of the invention, the sticking pads comprise a doping at their upper surface which is higher than the doping of the substrate material of the switching device. This can be used to localize the current of micro welding to smaller volume and therewith reduce the required energy and voltage, respectively.

In accordance with an additional feature of the invention, the movable frame is divided into two sections in order to enhance the mechanical stability and to reduce influences of fabrication tolerance.

Furthermore, if the side of the movable frame which is facing towards the gap reduction electrode is significantly wider compared to the other sides, the mechanical stiffness can be enhanced and undesirable bending and pull in due to the electrostatic force can be prevented. The side of the frame, which comes in contact to the sticking pads is realized to provide elasticity for a close contact to both sticking pads even when fabrication tolerances lead to different separations of the sticking pads to the corresponding side of the movable frame.

Because of low leakage currents, electric discharges during handling or during electrostatically assisted wafer level package procedures like anodic bonding may damage the electrodes or the contacts of the switching device. Therefore, in a further embodiment of the present invention metal bridges being released from the substrate by underetching are provided between electric lines which are electrically connected to fixed and to the movable electrodes during fabrication and/or handling of the switching device. According to a yet further embodiment, metal bridges with undercut are provided between electric lines which are electrically connected to the signal line and the ground line during fabrication and/or handling of the switching device. The metal bridges prevent voltage potential between the actuation electrodes or between the contacts during fabrication and handling. Thus, electric discharges and damages during fabrication and handling of the switching device as mentioned above can be significantly reduced if not eliminated. Since the metal bridges are undercut by a trench in the substrate, the heat conductivity and the thermal time constant of the metal bridges can be reduced.

In accordance with an alternative embodiment of the invention, the electric lines which are connected to the fixed and the movable electrodes, and the signal and the ground line, respectively, are electrically connected by contact windows in an isolation layer of the switching device and subsequent metallization to the substrate material during handling and/or wafer level packaging of the switching device to reduce electric discharges and damages.

If in that configuration at least one metal bridge being released from the substrate by underetching is inserted into the connection path to the contact windows, the metal bridges can be burned out by a current which has to be fed by a designated contact at the end of the fabrication and handling process of the switching device.

It is especially advantageous if the contact windows are formed by a locally doped region at an upper surface of the substrate, the locally doped region being connected by a metal, wherein the metal comprises an opening over the doped region. The locally doped region provides a reduced contact resistance of substrate material beneath the contact windows. The opening can be small and will be used for a further etch step at the end of fabrication procedure to underetch the contact window totally as an alternative arrangement to interrupt the electrical connection between the fixed and the movable electrodes, and between the signal and the ground line.

The resistance between the actuation terminal and the comb electrodes and the capacitance of the actuation electrodes both lead to a time constant of the electric system and to increased switching time. To overcome this difficulty, the electrodes of the switching device consist of silicon, wherein the silicon material is locally doped in the area of the drive. This results in reduced resistance and a decrease of the time constant of the electrical system.

The restoring springs provide a force when switching into the deactivated state, which is sufficiently high for contact separation and for overcoming the adhesion force of the contacts. The force of the restoring spring counteracts the force of the actuator and therewith reduces the contact force in the actuated-state. Consequently, it is desirable to use restoring springs with low stiffness. To be able to use springs with low stiffness without risking contact sticking due to adhesion forces, in an embodiment of the present invention an elastic beam element is provided between the push rod and contact tip(s) of the contact beam, wherein the mass of the push rod and the movable electrodes is more than three times higher than the mass of the contact beam and the contact tip(s). The elastic contact beam is compressed by the force of the actuator in the actuated state. At the time of switching into the non-actuated state, the electrodes and the push rod accelerate under the force of the restoring springs and of the compressed elastic contact beam. Initially, the contacts remain closed. Assuming sticking contacts, the separating force is temporarily amplified by the momentum of the electrodes and of the push rod.

Since the present invention includes a switching device in shunt-configuration, the contact metallization leads to strong capacitive coupling between the signal line and the ground line. Therefore, in another embodiment of the present invention, the signal line and/or the ground line are divided into two sides of strips at a location of the contact metallization, wherein the strips are separated in their depth from the substrate. This configuration leads to much lower coupling capacitance. The signal line or the ground line is divided into strips at the location of contact metal deposition. The strips are that narrow that under etching is easily possible. Separation from the substrate is required to avoid electrical connection between the strips. All but one of the strips per side is not electrically isolated to the RF electrodes. Only the outmost strip is electrically connected. The separation into strips yields lower coupling area and lower capacitance, respectively. The isolated strips cause a series connection of the coupling capacitance between the RF signal line and the strips and the capacitance between the RF ground and the strips. The series connection of capacitance yields a smaller capacitance as the original ones.

A hermetic sealing of the devices by WLP makes it usually necessary to have vertical vias in the substrate or in the cover which limits scaling down the outline. To overcome this in a specific example of the present invention, lines to electric terminals of the switching device are arranged in flat grooves within a sealing area of the switching device and are isolated by an isolation layer to the substrate and a further isolation layer covering the lines, wherein the further isolation layer is partly removed so that the surface of the substrate is flat in the line region. This leads to the formation of buried metal lines. Wafer level packaging by anodic bonding which requires very flat surfaces becomes possible as a consequence.

In another embodiment of the present invention, the ground line is intersected by a slot extending in the direction of the push rod.

In accordance with a preferred embodiment of the invention, the signal line of the switching device is interrupted at two locations by a gap respectively, and that there are two contact elements each comprising a movable beam extending at least partially opposite to the signal line and being electrically and mechanically connected to both parts of the signal line, and also mechanically connected to the push rod and therefore synchronously driven by the movable electrodes; wherein the ground line comprises at least one contact bar at the location of each gap of the signal line for forming the Ohmic contact between the contact beam and the ground line. Thus, the switching device of the present invention can be used in double contact shunt configuration.

Although the invention is illustrated and described herein as embodied in an electrostatically actuated micro-mechanical switching device, it is nevertheless not intended to be limited to the details shown, since various modifications and structural changes may be made therein without departing from the spirit of the invention and within the scope and range of equivalents of the claims.

The accompanying drawings are included to provide a further understanding of embodiments of the present invention and are incorporated in and constitute a part of this specification. The drawings illustrate embodiments of the present invention and together with the description serve to explain the principles of the invention. Other embodiments and many of the intended advantages will be readily appreciated as they become better understood by reference to the following detailed description. The elements of the drawings are not necessarily to scale relative to each other. Corresponding, functionally identical, or similar elements or details of the illustrated switching devices are identified with common or like reference numerals. To avoid repetition, the description of these elements or details which has been made with regard to a specific figure is also applicable for the other figures if not absolutely excluded.

DETAILED DESCRIPTION OF THE INVENTION

Figure 1:
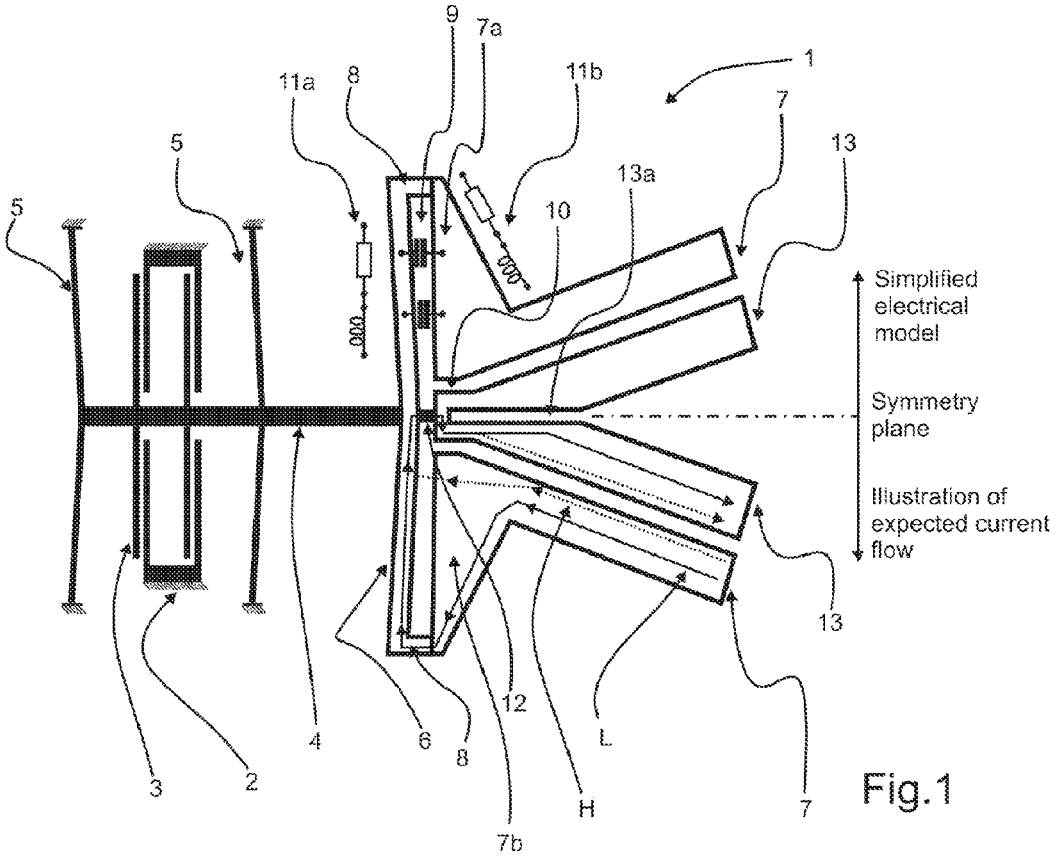
FIG. 1 illustrates schematically a plan view of a basic structure of an electrostatically actuated micro-mechanical switching device in shunt-configuration according to an embodiment of the present invention.

Referring now to the figures of the drawing in detail and first, particularly, to FIG. 1 thereof, there is shown a schematic plan view of a basic structure of an electrostatically actuated micro-mechanical switching device 1 in shunt-configuration according to an embodiment of the present invention. In FIG. 1, the shunt contact is closed.

The switching device 1 is formed in the bulk material of a crystalline silicon substrate. All movable parts of the switching device 1 consist of crystalline silicon and of metal. In other, non-illustrated embodiments of the present invention, the switching device 1 can also be formed in another micromechanically processible material.

In the illustrated plan view, the switching device 1 is substantially symmetrically formed. The switching device 1 comprises a drive with comb-shaped electrodes 2, 3. The comb-shaped electrodes comprise fixed electrodes 2 being in direct mechanical connection with the substrate and movable electrodes 3 being separated from the substrate material. The movable electrodes 3 can be moved horizontally in a plane of the substrate. To simplify matters, in FIG. 1 shows only two pairs of fixed and movable electrodes 2, 3, whereas in practice the drive consists typically of a plurality of fixed and movable electrodes 2, 3 being opposite to each other, respectively. The minimum electrode separation given by technology constraints and the application related actuation voltage, both limit the electrostatic actuation force and the switching time as well as the contact reliability of the switching device 1 as a consequence.

The movable electrodes 3 extend from both sides of a movable push rod 4 extending centrally through the electrodes 2, 3. The push rod 4 is suspended on at least one restoring spring 5 which is on one side mechanically connected with the substrate. In the example of FIG. 1, two restoring springs 5 are provided at an end portion of the push rod 4, and further restoring springs 5 are provided at a middle portion of the push rod 4. In other, non-illustrated embodiments of the present invention the number and the position of the restoring springs relative to the push rod 4 can be varied relative to the configuration of FIG. 1.

On a non-suspended end of the push rod 4, a movable or flexible contact beam 6 is provided. The contact beam 6 extends transversely to the push rod 4 and at least partially opposite or in parallel to a signal line 7 of the switching device 1. The contact beam 6 has a specific inductance and resistance, identified schematically by the reference numeral 11*a* in FIG. 1. The dimensions of the contact beam 6 are chosen so that it provides high elasticity. Therefore, the contact beam 6 is relatively long and thin. The contact beam 6 comprises at its both ends two contact pins 8, respectively, at which the contact beam 6 is electrically and mechanically connected with the signal line 7. The isolation of Ohmic switches in high frequency range is limited by capacitive cross-talk from input port to output port.

Because, as mentioned above, the contact beam 6 extends at least partially opposite the signal line 7, there is a coupling capacitance 9, shown schematically in FIG. 1, between the signal line 7 and the contact beam 6.

In operation of the switching device 1, the contact beam 6 will be bended by an actuation force applied on the contact beam 6 by a co-operation of the electrodes 2, 3, the push rod 4 and the restoring springs 5. Because of the high elasticity of the contact beam 6, it provides only a low force counteracting the actuation.

The signal line 7 is divided into two parts 7*a*, 7*b* by a gap 10, wherein each contact pin 8 of the contact beam 6 is connected with one of these parts 7*a*, 7*b*. The signal line 7 is typically an RF electrode and has a specific inductance and resistance 11*b*.

In the example of FIG. 1, a ground line 13 of the switching device 1 is intersected into two connected parts by a slot 13*a* which extends in the direction of the push rod 4. A contact bar 12 of the ground line 13 extends through the gap 10 and is in the shown actuated state in contact with the contact beam 6 and in a non-actuated state of the switching device 1 not connected with the contact beam 6. The restoring springs 5 counteract the actuation force of the drive and separate in the non-actuated state of the switching device 1 the contact beam 6 from the contact bar 12 of the ground line 13. In the example shown in FIG. 1, the ground line 13 is V-like formed and comprises a slot 13*a* between the axles of the "V". In other, not shown embodiments of the present invention, the signal line 7 as well as the ground line 13 can be formed in another way as it is shown in FIG. 1. But in all cases, the signal line 7 and the ground line 13 are provided on that side of the contact beam 6 opposite to the actuation mechanism of the switching device 1.

Figure 2:
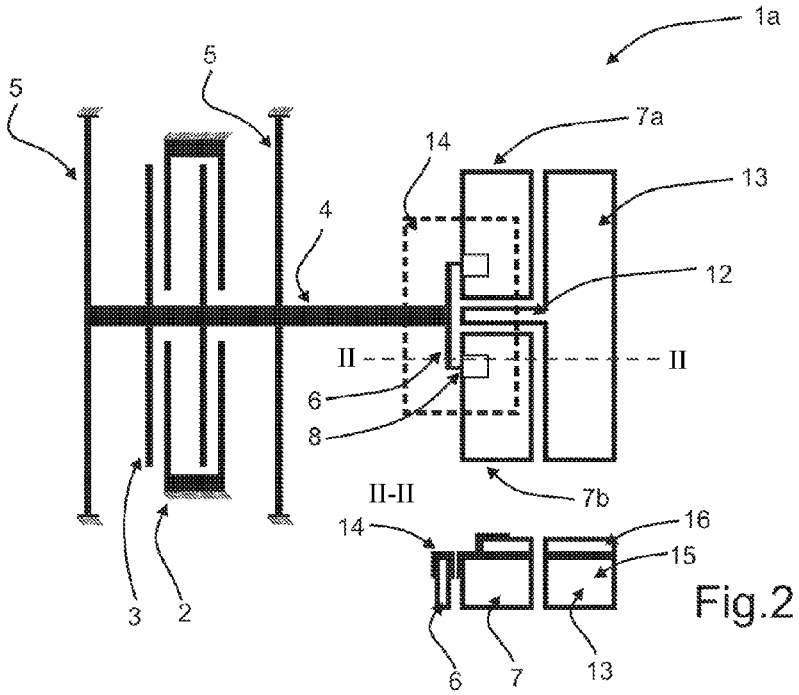
FIG. 2 illustrates schematically a plan and a cross-sectional view of a switching device according to an embodiment of the present invention with a shown contact metallization area.

As shown for instance in FIG. 2, the contact beam 6 and parts of the signal line 7 and the ground line 13 are covered on top and on the side walls of these elements with a contact metallization 14.

As illustrated schematically by the continuous line L and the dashed line H in the lower part of FIG. 1, during operation of the switching device 1, there is a low frequency current path L and a high frequency current path H. The low frequency current path L flows from the signal line 7*b* through the broadest extension of the signal line 7*b*, through the contact pin 8, through the contact beam 6, and through the contact bar 12 on a long way to the ground line 13. The high frequency current path H flows on a short way from the signal line 7*b* through a small part of the contact beam 6, and through the contact bar 12 on a short way to the ground line 13.

The upper part of FIG. 2 also illustrates schematically a plan view of a switching device 1*a* according to an embodiment of the present invention with a shown area of contact metallization 14. The lower part of FIG. 2 shows a cross-section along intersection line II-II of the upper part of FIG. 2. As shown, in the area of contact metallization 14, the contact beam 6 consisting of the substrate 15 material is covered with the metallization 14, wherein parts of the signal line 7 and the ground line 13 which consist in other area of the substrate 15 being covered with a metal layer 16 are additionally covered with the contact metallization 14 on top and on the side walls.

The contact metallization 14 leads to a significant decrease of the resistance of the contact beam 6, the signal line 7 and the ground line 13 in this area. As mentioned above, the contact metallization 14 covers also the sidewalls of the structures. This is required for obtaining an Ohmic contact between the contact beam 6 and the ground line 13 by lateral movement. The contact metallization 14 can be formed for instance by metal sputtering after structuring of the contact beam 6. A shadow mask has to be applied for defining the area of contact metallization 14. Alternatively, a relatively thick metal layer can be applied before structuring of the movable part by electroplating. It may be used as contact material for the movable and the fixed contacts as well. For this process, it is necessary to protect that metal layer during silicon etch processes, wherein a contamination of the contact surface during subsequent processes is possible.

Figure 3:
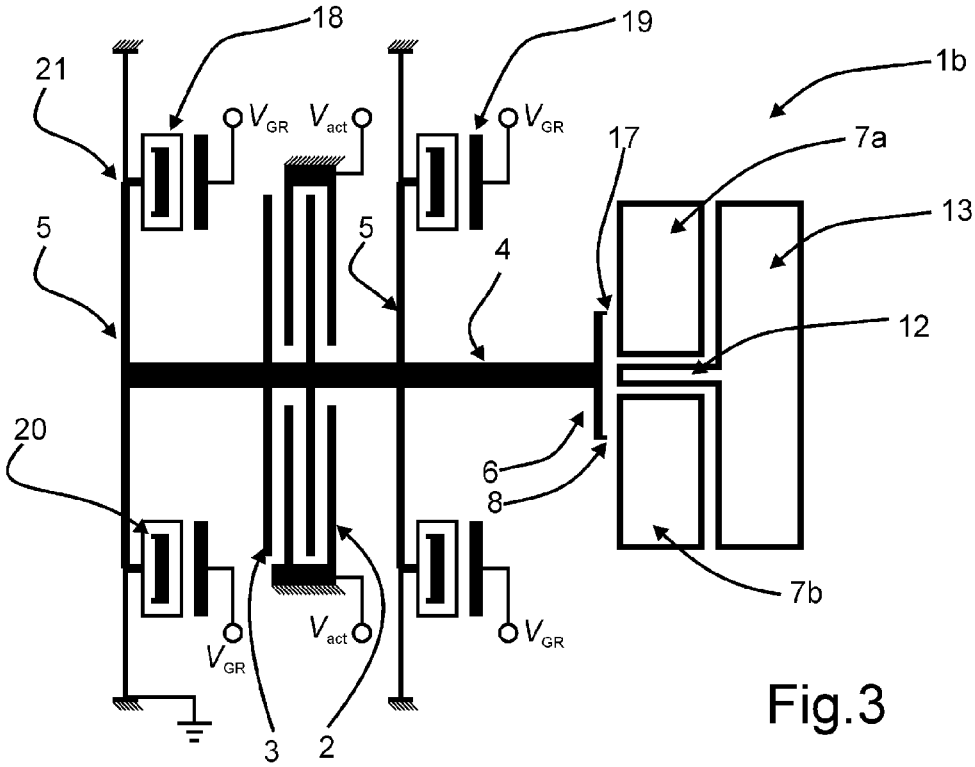
FIG. 3 illustrates schematically a plan view of a switching device according to a further embodiment of the present invention with a mechanism for gap reduction before activation of that mechanism.
Figure 4:
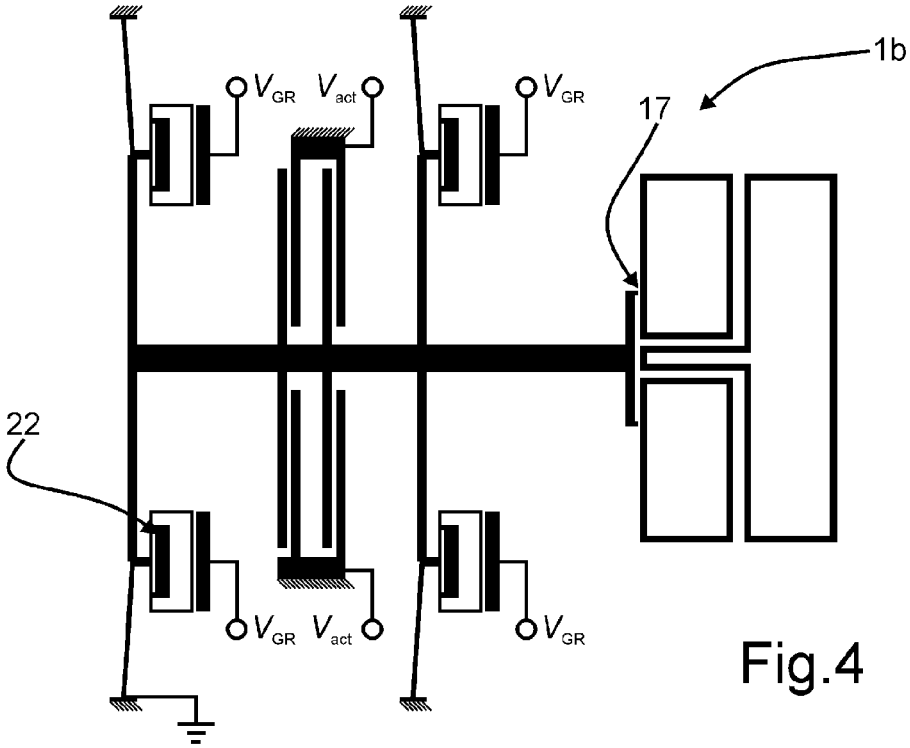
FIG. 4 illustrates schematically the switching device of FIG. 3 after activation of the mechanism for gap reduction.

FIG. 3 illustrates a schematic plan view of a further switching device 1*b* in accordance with a further embodiment of the present invention. The switching device 1*b* comprises equal or similar elements and details a the switching devices 1, 1*a* illustrated in FIGS. 1 and 2, and the switching device 1*b* additionally comprises a mechanism for gap reduction shown before an activation of that mechanism. FIG. 4 illustrates schematically the switching device of FIG. 3 after activation of the mechanism for gap reduction.

In the state shown in FIG. 3, the contact beam 6 is not mechanically and electrically connected with the parts 7*a*, 7*b* of the signal line 7. Instead, there is a contact separation 17 before the below-described gap reduction.

To realize a gap reduction resulting in a contact between the contact beam 6 and the signal line 7 as shown in FIG. 4, movable frames 18, additional attracting electrodes 19, and sticking pads 20 are inserted at the fixed ends 21 of each restoring spring 5, respectively. The movable frame 18 at least partially surrounds at least one sticking pad 20 and is opposite to at least one of the additional electrodes 19. The movable frame 18 is elastically suspended by further elastic beams and anchors so that the movable frame 18 moves towards the sticking pads 20 when an activation voltage is applied to the additional electrode 19 using the probe pads for the electric connection. Thus, the movable part of the switching device 1*b* including the contact beam 6, the push rod 4, and the movable driving electrodes 3 are moved the same way leading to a reduced separation of the movable electrodes 3 to the fixed electrodes 2 at one side and to a reduced contact separation 17, as shown in FIG. 4, in the non-actuated state. As also shown in FIG. 4, the movable frame 18 comes to rest 22 at the at least one sticking pad 20. Then, the sticking pads 20 and the movable frame 18 are permanently joined by a micro welding procedure applying a current trough the sticking pads 20 and the movable frame 18. The sticking pads 20 can be heavily doped at their upper surface to localize the current of micro welding to smaller volume and therewith reduce the required energy and voltage, respectively.

In a particular, not shown embodiment, the movable frame 18 can also be divided into two sections in order to enhance the mechanical stability and to reduce influences of fabrication tolerance. Furthermore, the side of the movable frame 18 which is facing towards the additional electrode 19 is significantly wider compared to the other sides in order to enhance the mechanical stiffness and to prevent undesirable bending and pull in due to the electrostatic force. The side of the movable frame 18 which comes in contact to the sticking pad(s) 20 is realized to provide elasticity for a close contact to the sticking pad(s) 20 even when fabrication tolerances lead to different separations of the sticking pad(s) 20 to the corresponding side of the movable frame 18.

In the embodiment of FIGS. 3 and 4, the sticking pads 20 are arranged that way that they come into contact to the corresponding side of the movable frame 18 near to the connection between movable frame 18 and restoring spring 5. It reduces the influence of fabrication tolerances to the restoring force 5.

As shown in FIG. 4, after performing the above described gap reduction procedure with every movable frame 18, the driving electrode separation and the contact separation 17 are permanently reduced.

Figure 5:
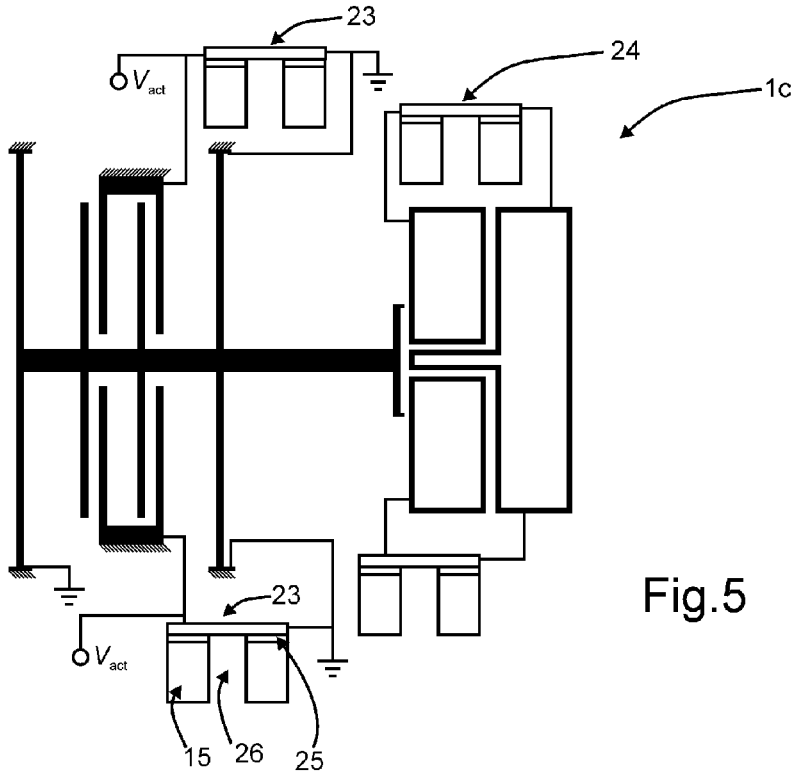
FIG. 5 illustrates schematically a plan view of a switching device according to another embodiment of the present invention with metal fuses shown also in a cross-sectional view.

FIG. 5 illustrates schematically a plan view of a switching device 1*c* according to another embodiment of the present invention, wherein the switching device 1*c* comprises metal fuses in the form of metal bridges 23, 24 which are shown in a cross-sectional view, too.

The metal bridges 23, 24 which electrically connect the actuation electrodes 2, 3 and the contacts (signal line 7 and ground line 13) prevent voltage potential between the actuation electrodes or between the contacts during fabrication and handling. As shown in the cross-sectional views of the metal bridges 23, 24 in FIG. 5, the metal bridges 23, 24 are formed as free-standing bridges on an isolation 25 formed on the substrate 15 and are undercut by a trench 26 in the substrate 15 in order to reduce the heat conductivity and the thermal time constant of the metal bridges 23, 24. An initial step in the test of the switching device 1*c* is to load these metal bridges 23, 24 by an appropriate current in order to burn out them and to disconnect the electrodes 2, 3 and the signal line 7 and the ground line 13 from each other.

Figure 6:
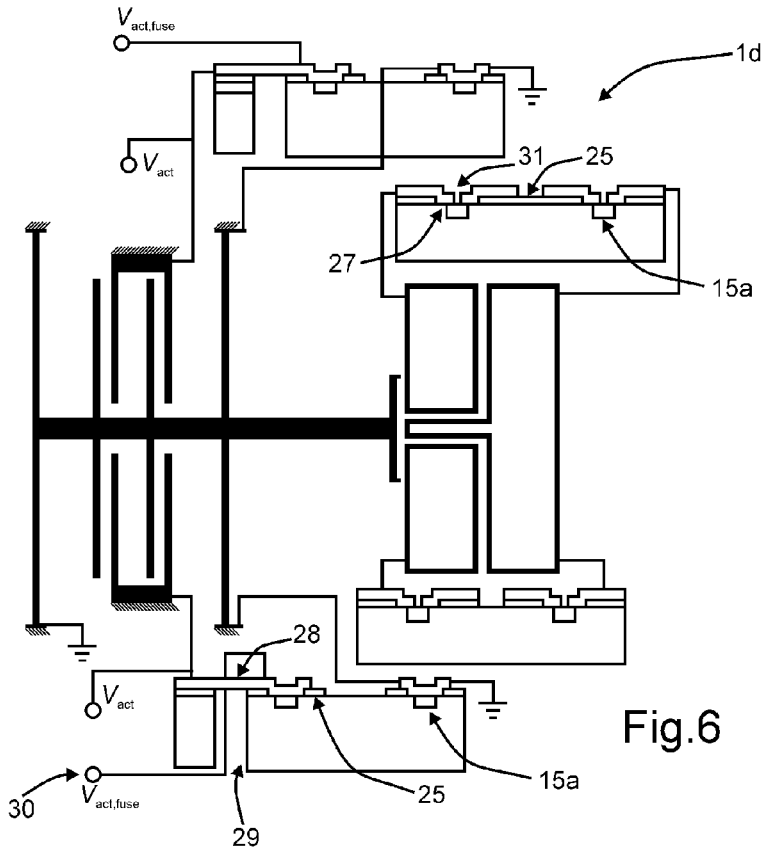
FIG. 6 illustrates schematically a plan view of a switching device according to yet another embodiment of the present invention with metal fuses shown also in a cross-sectional view and high resistance current path.

FIG. 6 is a schematic plan view of a switching device 1*d* according to yet another embodiment of the present invention with metal fuses and a high resistance current path.

In the embodiment of FIG. 6, the signal line 7 and the ground line 13 are connected to the substrate 15 by connecting windows 27 in an isolation layer 25. Local doping of the substrate 15 material leads to a layer of doped silicon 15*a* beneath the contact windows 27 and reduces the contact resistance. Metal bridges 28 with undercut 29 are inserted into the connection to these contact windows 27. In order to remove this electric connection which may cause losses of the RF signal, the connection to the substrate 15 can be removed by a further etch step at the end of the fabrication procedure. During this etch step, the silicon underneath the contact window 27 is removed and therewith the connection between the metal and the substrate 15. In areas where an additional contact pad does not degrade the RF performance, the electrical connection to the substrate 15 can be removed furthermore by a burn out of the metal bridges 28. The metal bridges 28 can be burned out by a current which has to be fed by a designated contact pad 30. In the example of FIG. 6, the metal of the contact windows 27 has a small opening 31 in the middle which is used for a further etch step at the end of fabrication procedure to underetch the contact window 27.

Figure 7:
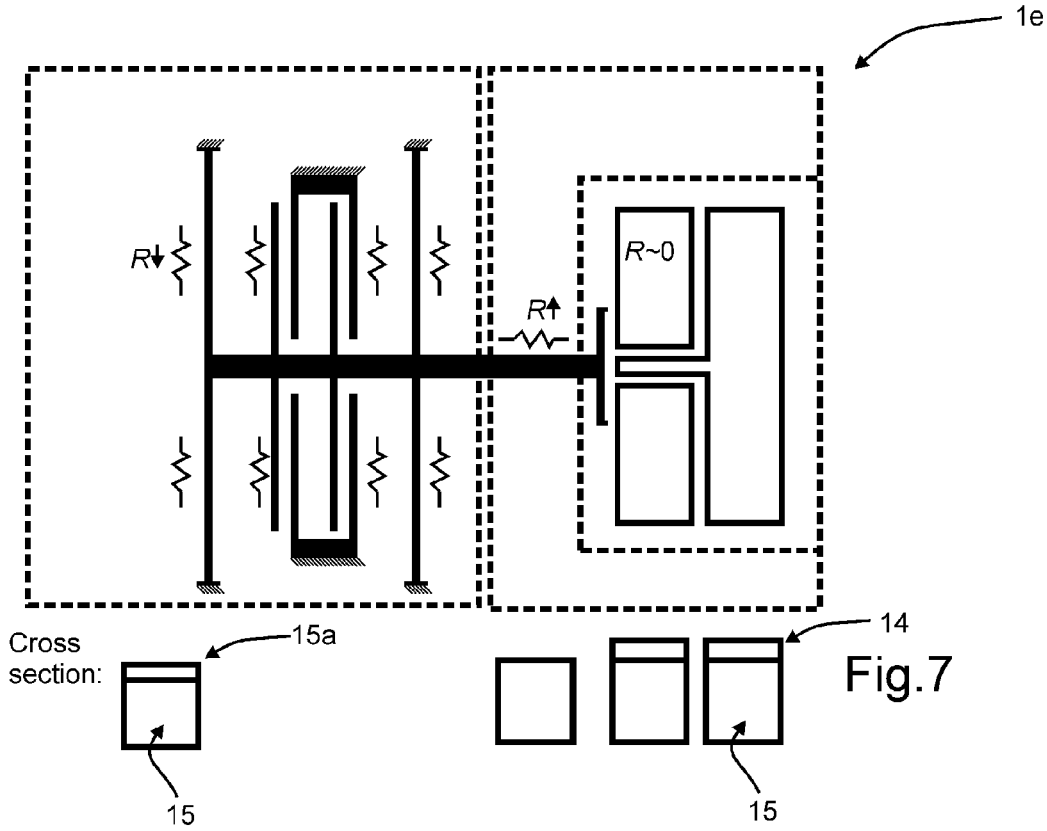
FIG. 7 illustrates schematically a plan and a cross-sectional view of a switching device according to yet further embodiment of the present invention with locally doped silicon.

FIG. 7 illustrates schematically a plan and a cross-sectional view of a switching device 1*e* according to yet further embodiment of the present invention with locally doped silicon. In the switching device 1*e*, the substrate 15 is of silicon and the surface of the silicon material is locally doped in the area of the driving electrodes 2, 3. This results in reduced resistance and a decrease of the time constant of the electrical system.

Figure 8:
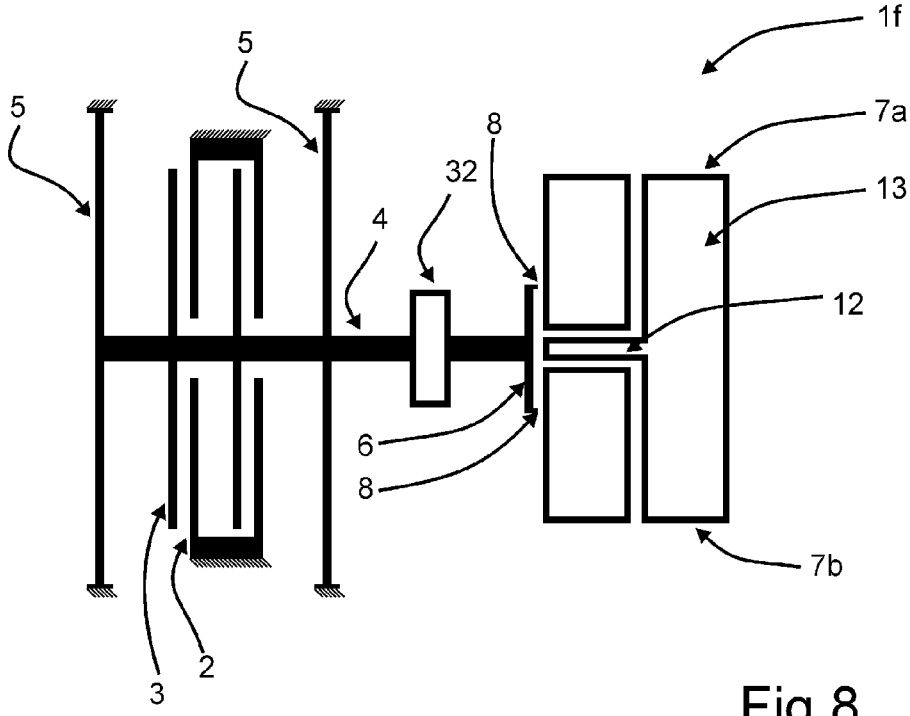
FIG. 8 illustrates schematically a plan view of a switching device according to a next embodiment of the present invention with an elastic beam in non-actuated state of the switching device.

FIG. 8 illustrates schematically a plan view of a switching device 1*f* according to a next embodiment of the present invention with an elastic beam in a non-actuated state of the switching device 1*f*.

The restoring springs 5 provide a force when switching into the deactivated state, which is sufficiently high for contact separation and for overcoming the adhesion force of the contacts. The force of the restoring spring 5 counteracts the force of the actuator and therewith reduces the contact force in the actuated-state. Consequently, it is desirable to use restoring springs 5 with low stiffness. To be able to use restoring springs 5 with low stiffness without risking contact sticking due to adhesion forces, in the embodiment of FIG. 8 an elastic beam element 32 is inserted between push rod 4 and the contact beam 6, and the push rod 4 and the movable comb electrodes 2, 3 are designed that way to have a significantly higher mass compared to the contact beam 6 with its contact tips 8.

Figure 9:
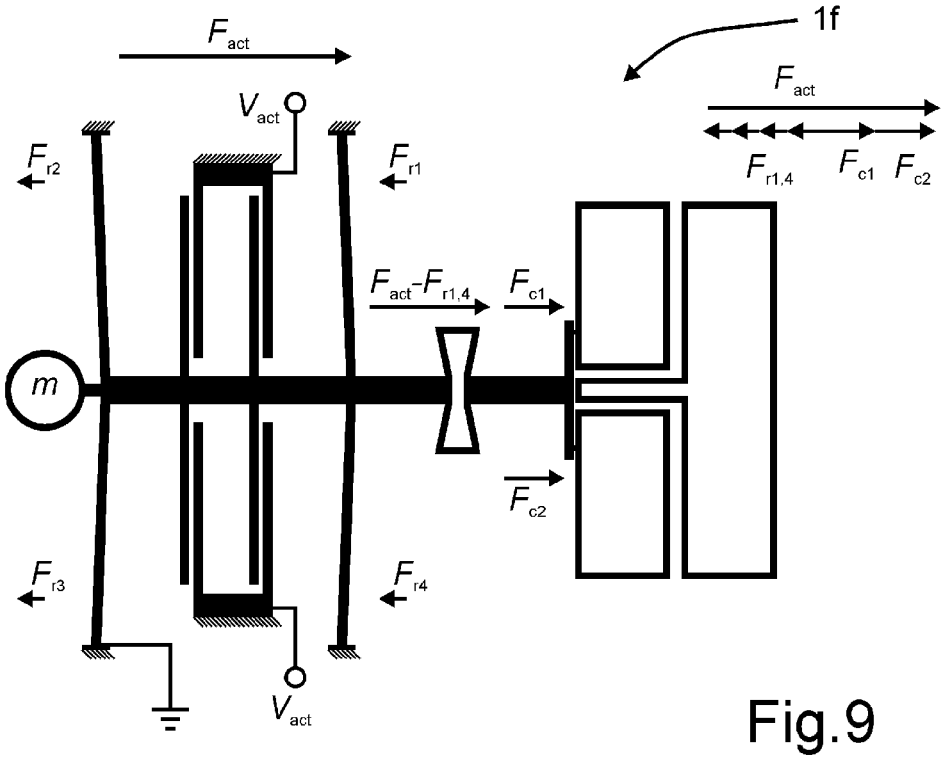
FIG. 9 illustrates schematically the switching device of FIG. 8 in an actuated state.
Figure 10:
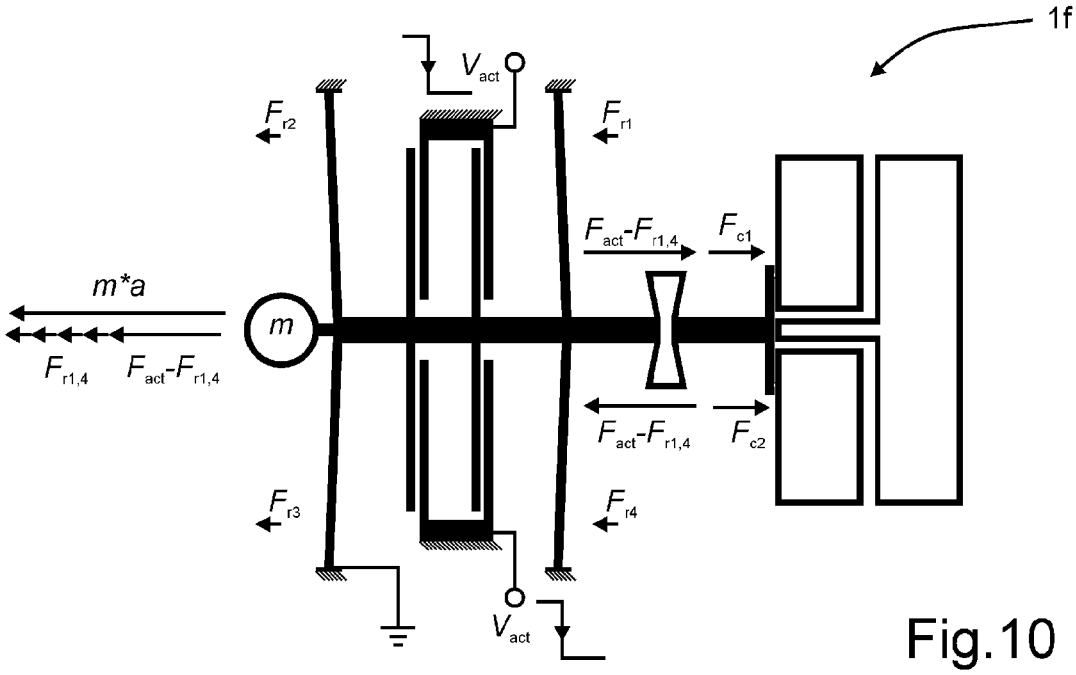
FIG. 10 illustrates schematically the switching device of FIGS. 8 and 9 during switching between an on- and an off-state of the switching device.
Figure 11:
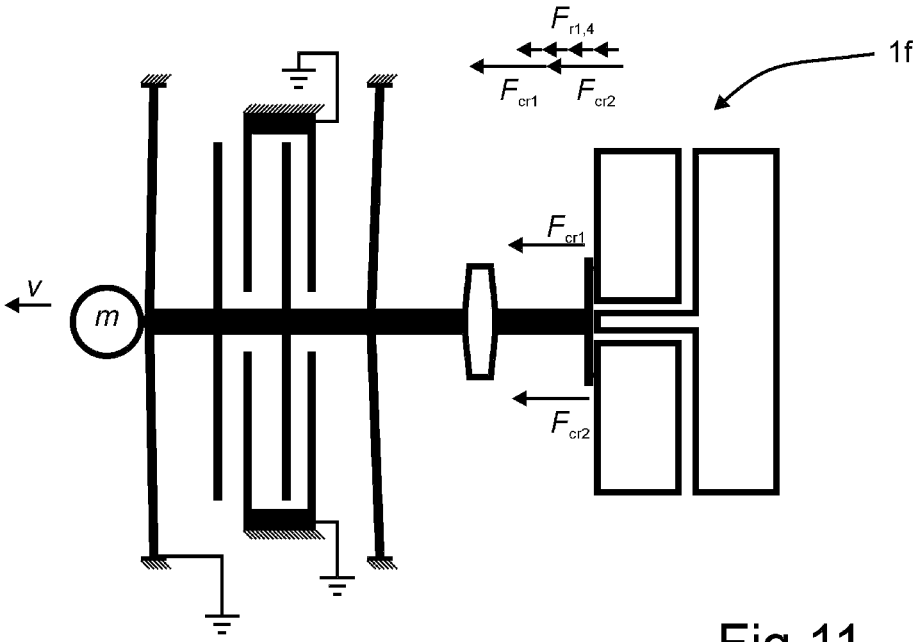
FIG. 11 illustrates schematically the switching device of FIGS. 8 to 10 showing the force amplification by momentum.

As shown in FIG. 9, the elastic beam element 32 is compressed by the force of the actuator in the actuated state. As shown in FIG. 10, at the time of switching into the non-actuated state the electrodes 2, 3 and the push rod 4 accelerate under the force of the restoring springs 5 and of the compressed elastic beam element 32. Initially, the contacts between the contact beam 6 and the parts 7*a*, 7*b* of the signal line 7 remain closed. Assuming sticking contacts, the separating force is temporarily amplified by the momentum of the electrodes 2 and of the push rod 4, as shown in FIG. 11, in order to separate the contact bar 12 from the contact beam 6 even in case of adhesion.

Figure 12:
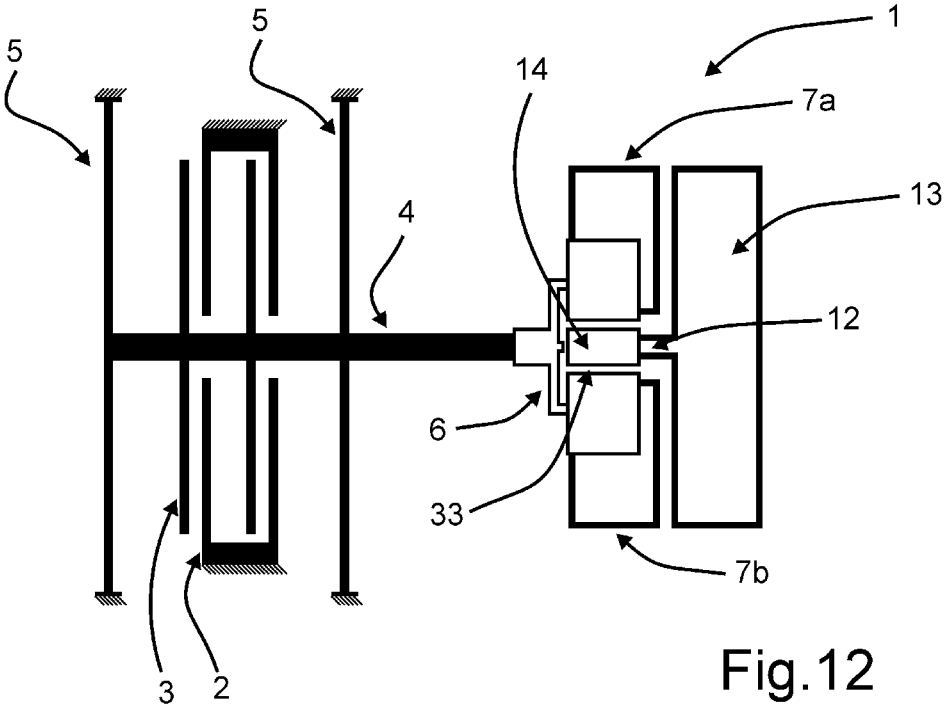
FIG. 12 illustrates schematically a plan view of a switching device according to an embodiment of the present invention with a shown contact metallization area on the contact tips of the contact beam and on parts of the signal line and the ground line.

FIG. 12 illustrates schematically a plan view of a switching device 1 according to an embodiment of the present invention with a shown contact metallization 4 area on the contact tips 8 of the contact beam 6 and on parts of the signal line 7 and the ground line 13. There is a very small separation 33 between the metalized surface of the signal line 7 and the ground line 13. Therefore, the contact metallization 14 leads to strong capacitive coupling between the RF signal line 7 and the RF ground line 13. As shown in FIG. 12, the contact metal does not only cover the surface, it covers the side walls of the structure up to a certain depth as well. Assuming a depth of 50 μm, a separation of 3 μm and a length of 80 μm, the metallization yields a capacitance of 12 fF. This capacitance causes a coupling reactance of −220 jΩ which is sufficiently low to cause matching issues.

Figure 13:
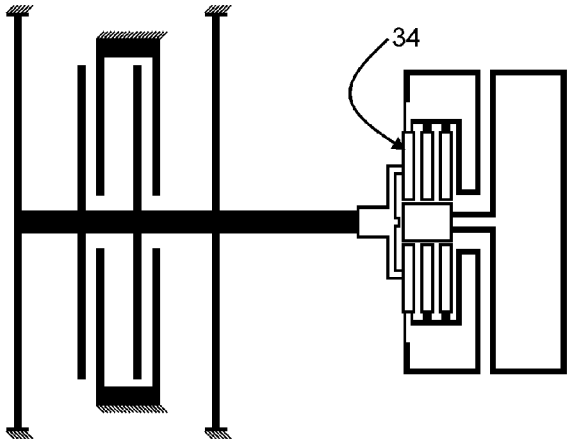
FIG. 13 illustrates schematically a plan view of a switching device according to another embodiment of the present invention with a strip shaped signal line and a contact metallization.

FIG. 13 shows a configuration with leads to much lower coupling capacitance. The signal line 7 or the ground line 13 is divided into strips 34 at the location of contact metallization 14. The strips 34 are that narrow that underetching is easily possible. Separation from the substrate 15 is required to avoid electrical connection between the strips 34. All but one of the strips 34 per side is not electrically isolated to the RF electrodes 7, 13. Only the outmost strip is electrically connected. The separation into strips 34 yields lower coupling area and lower capacitance, respectively. The isolated strips 34 cause a series connection of the coupling capacitance between the RF signal line 7 and the strips 34 and the capacitance between the RF ground line 13 and the strips 34. The series connection of capacitance yields a smaller capacitance in comparison to the original ones.

Figure 14:
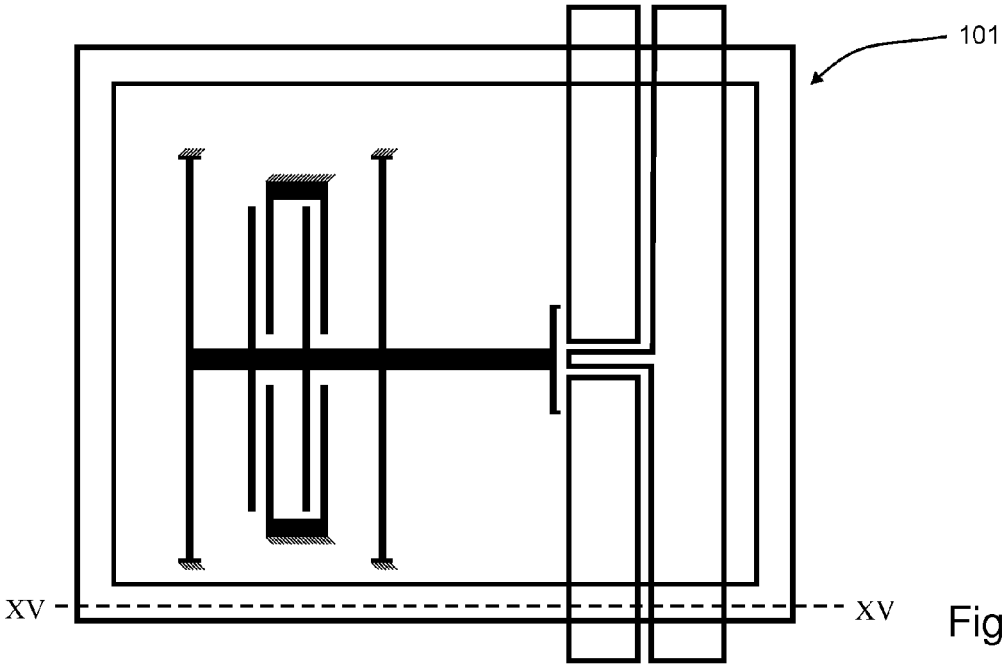
FIG. 14 illustrates schematically a plan view of a switching device according to a further embodiment of the present invention wherein the electric terminals are arranged in flat grooves and isolated by an isolation layer.
Figure 15:
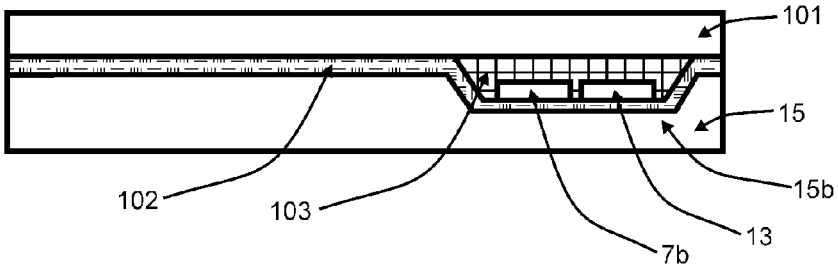
FIG. 15 is a view of a section taken along the line XV-XV in FIG. 14.

A hermetic sealing of the switching devices described above by wafer level packaging (WLP) makes it usually necessary to have vertical vias in the substrate 15 or in the cover 101 which limits scaling down the outline. To overcome this, in another embodiment of the present invention shown in FIG. 14 the metal lines to the electric terminals are arranged in flat grooves 15*b* within the sealing area of the switching devices and isolated by an isolation layer 102 to the substrate 15 for a lateral feed trough instead of vertical vias. A further isolation layer 103 covers the metal lines and is partly removed that way that the surface is flat in this region, wherein buried metal lines are formed. Wafer level packaging by anodic bonding which requires very flat surfaces becomes possible as a consequence.

The invention claimed is:

1. An electrostatically actuated micro-mechanical switching device, comprising:

movable elements formed in a bulk of a substrate for closing and releasing at least one Ohmic contact by a horizontal movement of said movable elements in a plane of the substrate, including:

a drive with comb-shaped electrodes, said electrodes including fixed driving electrodes and movable electrodes;

a movable push rod mechanically connected with said movable electrodes and extending through said comb-shaped electrodes;

at least one restoring spring mechanically connected with said push rod;

a signal line having two parts interrupted by a gap;

a contact element mechanically connected with one side of said push rod, said contact element including a movable contact beam extending at least partially opposite said signal line and being electrically and mechanically connected to each of said two parts of said signal line;

a ground line having at least one contact bar extending through said gap in said signal line for forming the Ohmic contact between said contact beam and said ground line; and a contact metallization formed at least on top and on side walls of said contact beam, of said signal line, and of said ground line; and wherein the switching device is in shunt-configuration for closing and releasing the Ohmic contact between said ground line and said signal line.

2. The switching device according to claim 1, which further comprises a movable frame provided at a fixed end of each said restoring spring and at least partially surrounding one fixed sticking pad, wherein said movable frame is opposite to at least one additional attracting electrode and elastically suspended so that the movable frame moves towards said sticking pad when an activation voltage is applied to said additional attracting electrode, wherein said movable frame comes to rest at said sticking pad at the side of the connection between said movable frame and said restoring spring, and wherein said sticking pad and said movable frame are permanently joined in that constellation by micro welding.

3. The switching device according to claim 2, wherein said sticking pads comprise a doping at their upper surface that is higher than a doping of the substrate material of the switching device.

4. The switching device according to claim 2, wherein said movable frame is divided into two sections.

5. The switching device according to claim 2, wherein a side of said movable frame facing towards said additional attracting electrode is wider compared to the other sides thereof.

6. The switching device according to claim 1, which comprises metal bridges formed in said substrate by underetching between electric lines that are electrically connected to said fixed electrodes and to said movable electrodes during fabrication and/or handling of the switching device.

7. The switching device according to claim 1, which comprises metal bridges formed in said substrate by underetching between electric lines that are electrically connected to said signal line and said ground line during fabrication and/or handling of the switching device.

8. The switching device according to claim 1, which comprises electric lines connected to said fixed electrodes and said movable electrodes, and said signal line and said ground line, respectively, said electric lines being electrically connected by contact windows in an isolation layer of the switching device and subsequent metallization to the substrate material during handling and/or wafer level packaging of the switching device.

9. The switching device according to claim 8, wherein at least one metal bridge with undercut is inserted into a connection path to said contact windows.

10. The switching device according to claim 8, wherein said contact windows are formed by a locally doped region at an upper surface of the substrate, said locally doped region being connected temporarily by a metal, the metal comprising an opening over the doped region, and the doped region being at least partially removed after bonding of the switching device in order to cut a short circuit between metal and bulk.

11. The switching device according to claim 1, wherein said electrodes consist of silicon, and wherein the silicon is locally doped in an area of the drive.

12. The switching device according to claim 1, which comprises an elastic beam element disposed between said push rod and one or more contact tips of said contact beam, wherein a mass of said push rod and said movable electrodes is more than three times higher than a mass of said contact beam and said one or more contact tips.

13. The switching device according to claim 1, wherein one or both of said signal line and said ground line are divided into two sides of strips at a location of a contact metallization, and wherein said strips are separated in their depth from the substrate.

14. The switching device according to claim 1, which comprises lines connecting to electric terminals of the switching device disposed in flat grooves within a sealing area of the switching device and isolated by an isolation layer to the substrate and a further isolation layer covering the lines, wherein said further isolation layer is partly removed so that a surface of the substrate is flat in the line region.

15. The switching device according to claim 1, wherein said ground line is intersected by a slot extending in a direction of said push rod.

16. The switching device according to claim 1, wherein:

said signal line is interrupted at two locations by a respective gap;

said contact element is one of two contact elements each comprising a movable beam extending at least partially opposite to said signal line and being electrically and mechanically connected to both parts of said signal line and also mechanically connected to said push rod and therefore synchronously driven by said movable electrodes; and said ground line includes at least one contact bar at a location of each said gap of said signal line for forming the Ohmic contact between said contact beam and said ground line.

* * * * *